US006729391B2

(12) United States Patent
Hill et al.

(10) Patent No.: US 6,729,391 B2
(45) Date of Patent: May 4, 2004

(54) INSERTABLE PROGRESSING CAVITY PUMP

(75) Inventors: David Arthur Hill, Calgary (CA); Jennifer Caroline Sattler, Calgary (CA); Kevin Kimberley, Calgary (CA); John Hughes, Calgary (CA)

(73) Assignee: Kudu Industries Inc., Calgary (CA)

( * ) Notice: Subject to any disclaimer, the term of this patent is extended or adjusted under 35 U.S.C. 154(b) by 0 days.

(21) Appl. No.: 10/014,782

(22) Filed: Dec. 14, 2001

(65) Prior Publication Data

US 2003/0111221 A1 Jun. 19, 2003

(51) Int. Cl.[7] ..... E21B 43/00
(52) U.S. Cl. ..... 166/68.5; 166/105; 417/360
(58) Field of Search ..... 166/68, 68.5, 105; 417/360, 424.1, 424.2; 418/48

(56) References Cited

U.S. PATENT DOCUMENTS

| | | | | |
|---|---|---|---|---|
| 3,347,169 A | | 10/1967 | Cronin, Jr. et al. | |
| 4,592,427 A | | 6/1986 | Morgan | |
| 5,746,582 A | | 5/1998 | Patterson | |
| 5,871,051 A | | 2/1999 | Mann | |
| 5,954,483 A | * | 9/1999 | Tetzlaff | 417/360 |
| 5,988,992 A | | 11/1999 | Tetzlaff et al. | |
| 6,089,832 A | | 7/2000 | Patterson | |
| 6,193,474 B1 | | 2/2001 | Tetzlaff | |
| 2002/0195254 A1 | * | 12/2002 | Rowan et al. | 166/381 |

FOREIGN PATENT DOCUMENTS

| | | |
|---|---|---|
| CA | 2310198 | * 11/2001 |

* cited by examiner

*Primary Examiner*—William Neuder
(74) *Attorney, Agent, or Firm*—Bennett Jones LLP

(57) ABSTRACT

An insertable progressing cavity pump is taught. The pump is insertable in a bore of a tubing string by carriage on a drive string, the insertable progressing cavity pump includes a stator, a helical rotor locatable in the stator and including a coupling for connection to the drive string, a tubular housing for accommodating the stator therein and sized to be insertable into the tubing string, a pump hold-down arrangement in communication with the housing and disposed above the stator for engaging the pump into the tubing string, and a torque transmitting arrangement acting between the rotor and the housing to transmit torque from the rotor to the housing in both the clockwise and counter-clockwise direction, when the housing is carried on the drive string. The insertable progressing cavity pump in another aspect includes a hold down assembly disposed above the stator on the pump housing.

18 Claims, 5 Drawing Sheets

INSERTABLE PROGRESSING CAVITY PUMP

FIELD OF THE INVENTION

This invention relates to progressing cavity pumps and, in particular, a progressing cavity pump moveable through production tubing in a well and insertable through the tubing string into a set position downhole.

BACKGROUND OF THE INVENTION

A progressing cavity pump is a well known pump, frequently called a "Moineau" pump, that has an elastomeric outer element or stator has a helical inner surface. A metal rotor having a helical exterior inserts within the stator.

Progressing cavity pumps of this type are used for many purposes, particularly for pumping viscous liquids. These pumps are also used as oil well pumps. When used as an oil well pump, the stator is secured to the lower end of the well tubing and lowered into the casing of the well with the well tubing. The rotor is secured to the lower end of the sucker rod and lowered through the tubing to a position inside the stator. The sucker rod is rotated by means of a rotary power source at the surface. U.S. Pat. No 2,267,459 shows one type of installation for an oil pump.

One disadvantage is that if the stator needs to be serviced, the string of tubing must be pulled. This is time consuming and requires special equipment. U.S. Pat. No. 3,347,169 shows a insertable progressing cavity pump wherein the stator is lowered through the tubing on a flexible drive cable and secured by a seat.

U.S. Pat. No. 4,592,427 shows an insertable progressing cavity pump that is lowered through the tubing on sucker rods and secured by a seating nipple and torque reactor cup arrangement.

SUMMARY OF THE INVENTION

The progressing cavity pump of the present invention is lowered through the production tubing on a rod string. The pump is releasably latched down hole and held against rotation.

In accordance with a broad aspect of the invention, there is provided in an insertable progressing cavity pump, the pump being insertable in a bore of a tubing string by carriage on a drive string, the insertable progressing cavity pump comprising: a stator, a helical rotor locatable in the stator and including a coupling for connection to the drive string, a tubular housing for accommodating the stator therein and sized to be insertable into the tubing string, a pump hold-down arrangement in communication with the housing and disposed above the stator for engaging the pump into the tubing string, and a torque transmitting arrangement acting between the rotor and the housing to transmit torque from the rotor to the housing in both the clockwise and counter-clockwise direction, when the housing is carried on the drive string.

The torque transmitting arrangement can act directly or indirectly between the rotor and housing. In one embodiment, the torque transmitting arrangement includes a portion on the coupling and a portion on the housing.

The pump can include a collar on the housing and an enlarged sub on the coupling that are formed to cooperate to permit the pump to be carried on the drive string. In one embodiment, the torque transmitting arrangement is formed above the enlarged sub on the coupling and is selected to engage with an aperture that extends through the collar.

The torque transmitting arrangement acting between the rotor and the housing can be a portion on the housing that can engage with a portion on or in communication with the rotor such as a sub. As an example, the torque transmitting arrangement can be corresponding faceted arrangements such as hexagonal, square or rectangular openings/subs, corresponding oval openings/subs or frictionally interlocking arrangements such as vertically knurled components.

In another aspect of the invention, there is provided an insertable progressing cavity pump installation for use in a tubing string in a wellbore, the insertable progressing cavity pump installation comprising: a tubing string insert connectable into the tubing string and having a inner bore defined by an inner wall and pump hold down arrangement formed on the inner wall and an insertable progressing cavity pump insertable through the tubing string by carriage on a rod string, the pump including a stator, a helical rotor locatable in the stator and including a coupling for connection to the rod string, a tubular housing for accommodating the stator therein and sized to be insertable through the tubing string and an hold down arrangement on the housing disposed above the stator and including an engagement mechanism for engaging with the pump hold down arrangement to releasably secure the pump in the tubing string.

The pump hold down arrangement and the hold down arrangement on the housing can be various corresponding mechanisms or arrangements. As an example, the pump hold down arrangement and the hold down arrangement on the pump can be a corresponding arrangement of a collet and a shoulder, a key and a keyway, or a spring loaded block and a shoulder.

The pump can include a collar on the housing and an enlarged sub on the coupling that are formed to cooperate to permit the pump to be carried on the drive string. In one embodiment, the collar is formed adjacent the hold down arrangement on the housing.

The housing can be formed in various ways. In one embodiment, the housing includes an insert body including a collar for cooperating with an enlarged sub on the coupling to permit the pump to be carried on the drive string and the hold down arrangement on the housing.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DESCRIPTION OF THE PREFERRED EMBODIMENTS OF THE INVENTION

Figure 1:
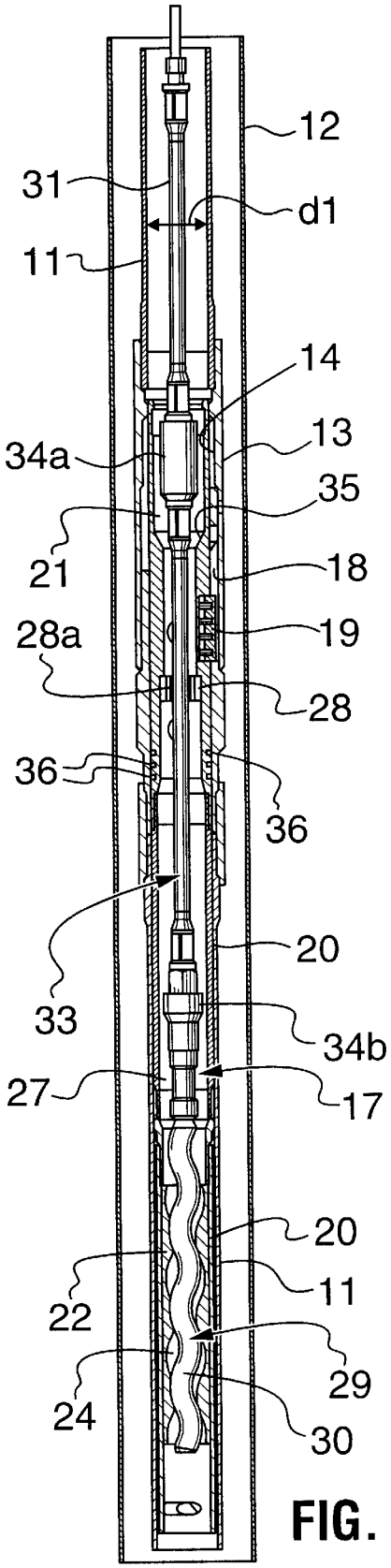
FIG. 1 is a vertical section through a portion of production tubing in a section of casing including in a set position therein an insertable progressing cavity pump according to the present invention with the rotor positioned in the stator.

Referring to FIG. 1, a portion of a string of production tubing is indicated at 11. Tubing string 11 extends in a well usually through casing 12. A tubing string hold down sub 13 is secured, as by threaded engagement, in the tubing string at a position below which it is desired that the stator of the pump extend. Sub 13 includes an inner wall 14 defining a central bore which is open to the central bore of the tubing string. Sub 13 is formed to releasably engage an insertable progressing cavity pump 17 (shown in the set position in FIG. 1) through a hold down arrangement between the pump and the tubing string sub. Generally, one part of the hold down arrangement is carried on the pump and a cooperating hold down part is supported on the tubing string hold down sub.

Inner wall 14 has a diameter that is generally equal to the diameter d1 of tubing 11 and about the same size or slightly larger than the outer diameter of pump 17. Sub 13 includes a hold down arrangement formed as a keyway 18 for releasably engaging a hold down key 19 biased outwardly from pump 17. Other hold down arrangements can be used, for example, a collet or spring biased block that engages on a shoulder formed in the tubing string.

Pump 17 includes a housing 20 with an inner bore 21 and therein a stator 22, which is elastomeric and has a helical inner bore 24. Also disposed above stator 22 is a flush-by area 27. Flush-by area 27 has an inner diameter greater than the diameter of bore 24. A collar 28 is formed in inner bore 21 of housing adjacent the upper end thereof. Collar 28 is mounted in the housing, for example, by threaded engagement, welds or by being formed integral therewith. Collar 28 defines a central aperture 28*a* therethrough. Pump housing 20 can be formed of one part including a section about the stator, the flush-by area and the collar end. Alternately, the pump housing can be formed in sections and the sections connected together in permanent or releasable ways such as, for example, by threaded connections, welding or fasteners.

The pump's rotor 29 includes a helical end 30 adapted to be located in the stator and rotated therein to pump liquids. Rotor 29 is connected to a rod string 31 by a drive rod 33. The rotor and drive rod can be formed integral with each other or as two or more sections, which are connected together by threads, welding or other means. Rod string 31 is of a conventional design such as, for example, including a plurality of rigid sucker rods extending to surface or a continuous rod. Drive rod 33 includes an upper compression sub 34*a* and a lower enlarged sub 34*b*, both of which have diameters enlarged over the diameter of the rod string. Subs 34*a* and 34*b* are sized to butt or engage against portions of the pump so that it can be moved. In particular, upper compression sub 34*a* is sized to butt against a compression face 35, or other part of the pump when the rod string is lowered and lower enlarged sub 34*b* has a diameter larger than the diameter of aperture 28*a* of collar and are formed to butt against collar 28 in the inner bore of the housing when the rod string is raised.

Rod string 31 can pass through aperture 28*a* with enough clearance such that well fluids can be pumped through the aperture. Rotor 29 can be moved by rod string 31 between a position within the stator and a position within the flush-by housing 27 but is prevented from being removed from the flush-by housing 27 by abutment of lower enlarged sub 34*b* against collar 28. Flush-by area 27 is of a length to permit rotor 29 to be fully withdrawn from stator bore 21.

Key 19 is biased outwardly from the outer surface of housing 20 above stator 22. The key, when outwardly biased, provides the pump housing with an outer diameter greater than d1. Key 19 can be biased outwardly in various ways, such as by springs, fluid pressure or elastomeric members, with sufficient pressure such that it will land in keyway 18 when it is reached. However, in one embodiment even with biasing pressure applied, key 19 can be depressed to permit the housing to fit into the tubing string and be moved along without unreasonable application of weight.

Seals 36, such as O-rings, are mounted about the outer surface of the housing and are sized such that they will seal against the inner surface of tubing string hold down sub 13. Seals 36 prevent formation solids from migrating down and becoming jammed between the pump and tubing 11.

In use, sub 13 is secured into a tubing string 11 and the entire string is lowered into a well. After the tubing 11 is positioned, as desired, in the well, the pump housing is supported on rod string 31 and, in particular, collar 28 is supported on enlarged sub 34*b*. The pump is run through tubing string 11 down to the position of sub 13. To do so, key 19 is depressed or retracted to introduce pump housing 20 into the tubing string and the housing is permitted to drop by gravity through the well, as supported by the rod string. While being lowered into the well, rotor 29 is positioned within the flush-by area and does not extend into bore 24 of the stator. Thus, as pump 17 moves through the tubing, well fluids can pass up through bore 24, through flush-by area 27 and out through aperture 28*a*. It the pump will not pass through the tubing string by gravity, it can be pushed down hole by abutment of upper sub 34*a* against face 35.

Once keyway 18 is reached, key 19 drops therein and the rod string will experience a decrease in weight at surface, indicating that the pump is set in the tubing string sub. When this occurs, the pump is in the set position wherein the pump is limited in its upward (toward surface) and its downward travel and the pump is prevented from rotating by abutment of key 19 against the edges of keyway 18. Seals 36 are sealed against a finished area on the inner surface of sub 13, sealing against passage of fluids and preventing materials from becoming jammed between housing 20 and sub 13 and tubing 11.

Once pump 17 is seated within sub 13, rod string 31 is lowered to move rotor 29 into bore 24 of the stator. Rotor 29 is lowered until compression sub 34*a* engages against compression face 35 at which point the exact position of the rotor with respect to the stator is known based on the selected length of the rotor and drive rod 33. The rod string is then pulled to surface a selected distance to move sub 34*a* sufficiently above compression face, with consideration as to rod stretch, to prevent the subs 34*a*, 34*b* from damaging the stator or pump housing. Rod string 31 is then connected to a rotary power source (not shown) for rotation.

When the string is rotated, rotor 29 also rotates to cause fluid to flow through bore 24, housing 20 and aperture 28a. Undesirable rotation of pump 17 during rod string rotation is avoided by abutment of key 19 against sides of keyway 18. The pump is supported in the tubing string by engagement of key 19 in keyway 18. Additional support is provided by forming pump housing 20 to fit with close tolerance within tubing string 11 such that the pump is supported against deflection out of axial alignment with the tubing string.

When it becomes necessary to pull the pump for maintenance, the drive string is uncoupled from the motor at the surface. Then string 31 is raised to cause lower sub 34*b* of the drive rod to move up and abut under collar 28. Continued upward force, dislodges key 19 from engagement with keyway 18. Depending on the nature of the interconnection between the key and the keyway, other manipulation such as rotation with pulling may be required to dislodge the key from the keyway. Once dislodged, the pump 17 is pulled to surface on rod string 31. Tubing 11 and sub 13 remain in the well.

Figure 2:
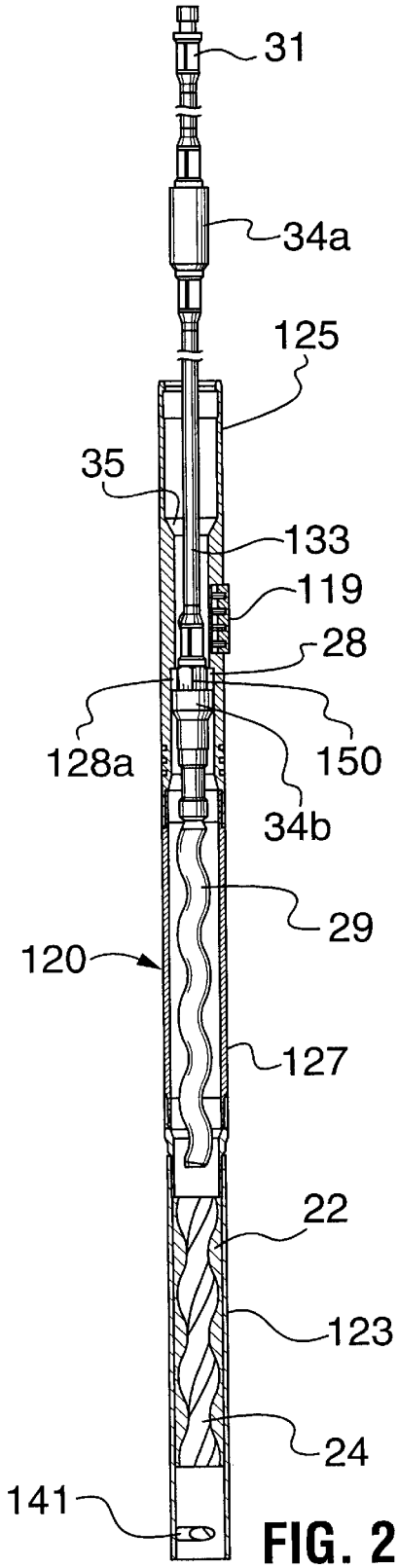
FIG. 2 is a vertical section of another insertable progressing cavity pump with the rotor removed from the stator and in engaged position for pulling uphole.
Figure 3A:
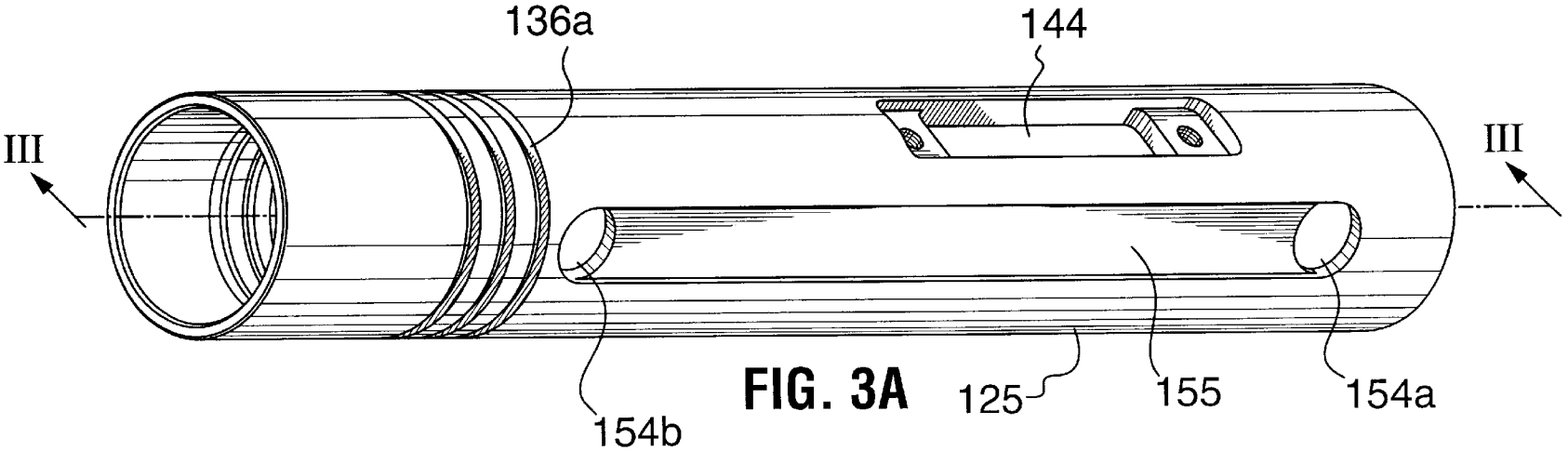
FIG. 3A is a perspective view of an insert body useful with an insertable progressing cavity pump.
Figure 3B:
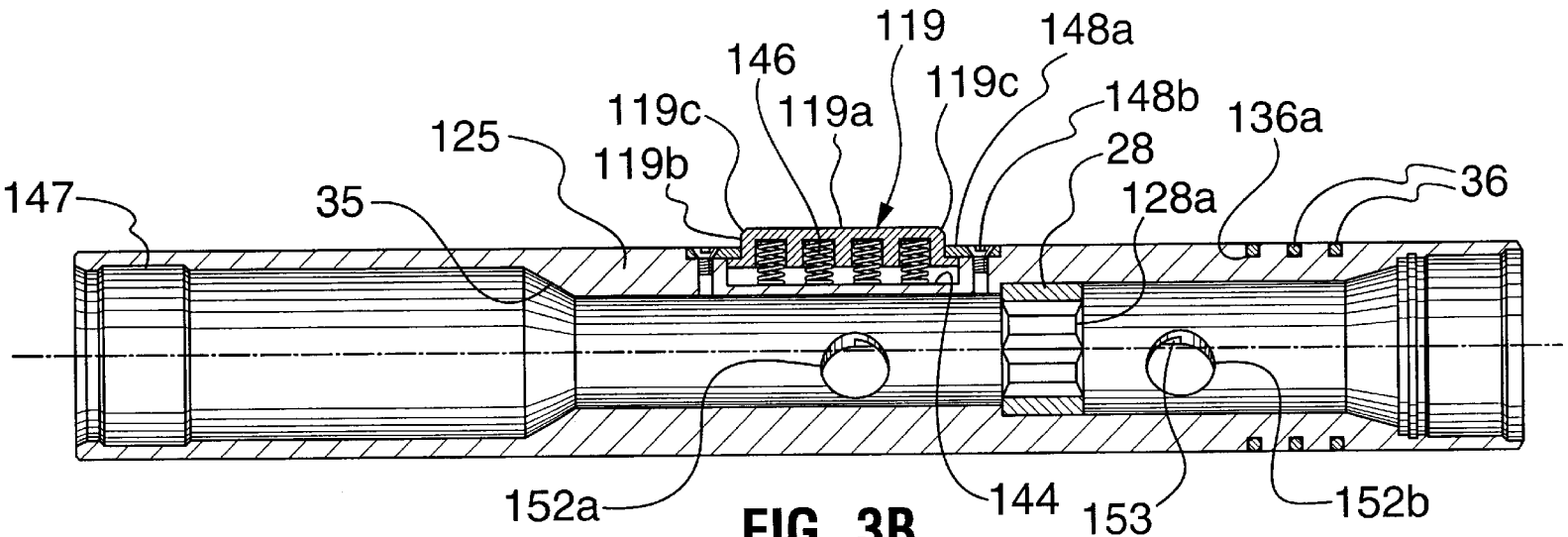
FIG. 3B is a sectional view along line III—III of FIG. 3A.

Referring to FIGS. 2 to 4, another insertable PC pump is shown. The pump includes a housing 120 mountable in a tubing string (not shown) by engagement to a tubing string hold down sub 113, a stator 22 and a rotor 29 driven by a drive string 31.

Housing 120 is formed in sections that are secured together by threaded connections. In particular, housing 120 includes a stator section 123 and thereabove a flush-by housing 127 and an insert body 125.

Stator 22 is mounted in the bore of stator section 123. A rotor catcher 141, which can be formed as a bar or plate, extends across the bore of section 123 below the stator. Rotor catcher 141 is positioned to prevent rotor 29 from dropping out of the pump if it or a piece thereof should become disconnected from drive rod 133 or rod string.

The flush-by housing is sized to permit the rotor to be drawn up out of stator bore 24 such that fluids can flow freely therethrough during movement of the pump through the tubing string in which it is used.

Insert body 125 includes the components for conveying the pump housing downhole and supporting it within the tubing string. In particular, insert body 125 includes a collar 28 with an aperture 128*a* therein. As noted hereinabove, the pump can be supported on lower enlarged sub 34*b* of drive rod 133. In this embodiment, aperture 128*a* is formed as part of an engagement mechanism to releasably interlock with the rotor or the drive rod to permit the transmission of torque from the drive string and rotor to the pump housing 120. In the illustrated embodiment, aperture 128*a* is formed as a hex to permit interlocking with a hex 150 formed on the drive rod. Hex 150 is formed on the drive rod just above lower sub 34*b*, such that when the drive rod is raised to butt sub 34*b* against collar 28, the hex 150 will interlock with the hex form of aperture 128*a*. When interlocked, any torque applied to the rotor through the drive string will be transmitted to the pump housing. This facilitates manipulation of the housing while it is hung off the drive string downhole. As will be appreciated, the interlocking arrangement can be released by simply lowering the drive string relative to the pump housing, so that hex 150 is moved out of engagement with aperture 128*a*. When the rotor is positioned in the stator to pump fluids, no interlock will occur between the drive rod and the pump housing.

While a hex arrangement has been illustrated as the engagement mechanism between the drive rod/rotor and the pump housing, other mechanisms can be used to provide engagement between the parts for the transmission of torque. As an example, other corresponding faceted arrangements such as square or rectangular openings/subs, corresponding oval openings/subs or frictionally interlocking arrangements such as vertically knurled components.

As will be appreciated, when hex 150 is interlocked with aperture 128*a*, the hex can block fluid passage through the aperture. This can be problematic as it interferes with movement of the pump through the tubing string. Thus, a fluid bypass can be provided about aperture 128*a*. Fluid bypass can be provided in various ways, such as by opening ports through collar 28 or forming the hex or aperture 128*a* to leave channels therebetween. In the illustrated embodiment, an upper bypass opening 152*a* is formed through the wall of insert body 125 above collar 28 and a lower bypass opening 152*b* is formed through the wall of the insert body below the collar. Thus, when the pump is pulled up hole, and the hex is in the position shown in FIG. 2, fluid passing down through insert body can pass through opening 152*a* into the annulus between the pump housing and the tubing string and then enter again through lower bypass opening 152*b* and continue down through the flush by housing and stator. A channel 153 can be formed between the openings along the outer surface of the insert body, if desired, to facilitate passage of fluid between the openings.

As will be appreciated, when the pump is being pushed down hole by engagement of compression sub 34*a* against compression face 35, fluid passage up through the pump will also be blocked. Thus, another pair of fluid bypass openings 154*a*, 154*b* and channel 155, which span compression face 35, can be provided. It is to be understood that other fluid bypass arrangements could be used, as desired to address the problem of blocking fluid flow through the bore.

When passage though the pump is not blocked by hex 150 or compression sub 34*a*, a major portion of the fluid passing up through the pump will tend to pass directly through the pump with a lesser amount taking the circuitous routes through openings 152*a*, 152*b* or 154*a*, 154*b*.

The upper end of insert body 125 has formed thereon a fishing profile 147 for engagement by a fishing tool (not shown), should that be required. The outer surface of the body 125 includes glands 136*a* for retaining seals 36, such as O-rings.

The insert body has mounted thereon a key 119 that is biased radially outwardly from the outer surface of the insert body. The key is mounted in a pocket 144 formed on the outer surface of the housing and is biased outwardly by springs 146 disposed between the pocket and the key. Straps 148*a* are secured over side flanges of the key by fasteners 148*b* to retain it in the pocket against the biasing force of the springs. The spring force biasing the key outwardly should be balanced between having a sufficient spring force to drive the key out when it reaches the keyway in the tubing string, while being soft enough to allow the pump to be moved through the tubing string, even though the key is biased against the tubing string inner wall.

In one embodiment, key 119 has a smooth face 119*a* such that it does not tend to engage against the inner wall of the tubing string, when the pump is passed therethrough. However, the edges 119*b* of the key are formed to extend out from pocket 144, such that the edges engage against the sides of the keyway in which the key is intended to lock. The leading and trailing ends 119*c* can be slightly radiused to permit the key to ride over small discontinuities in the inner wall, but not so radiused that it will ride out of keyway 118 once the key is locked therein.

One embodiment of a keyway is shown in detail in the hold down sub of FIG. 4. Keyway 118 is formed on the inner surface of tubing string hold down sub 113. The keyway is defined by an arrangement of stepped edges that intersect between diameters dA1 and dA2 in a relief area 159 in the bore of the sub and a second smaller diameter dB below the keyway. Guiding sides 160*a*, 160*b* extend down from an intersecting point 162 and define a keyway entrance that opens upwardly in sub 113 and leads down into an engaging slot 158. Slot 158 is defined by an upper end 158*a*, a lower end 158*b* and a stop side 158*c*.

Preferably diameter dB is generally not less than the inner diameter of the tubing string in which the hold down sub is to be used. This allows full bore access through the tubing string and sub 113. Diameter dA1 is greater than the inner diameter of the tubing string and diameter dA2 is greater still such that when the key moves into the sub above the keyway, the key can expand out in preparation for engagement against the keyway edges.

While keyway 118 can be formed in a tubing sub in various ways such as, for example by milling into the wall, by cutting into the wall and patching on the outer surface, etc., in the illustrated embodiment, the sub is formed of two connected parts. In particular, pin end 113*a* includes a liner that defines the shape of the keyway and is sized to telescopically fit within a tube 113*b* forming a box end of the tubing string hold down sub. Insertion of the liner into the tube is controlled by abutment of the tube against a shoulder 164 on pin end 113*a*. A welding window 166 is provided for attaching the liner adjacent point 162 to tube 113*b*.

Figure 4A:
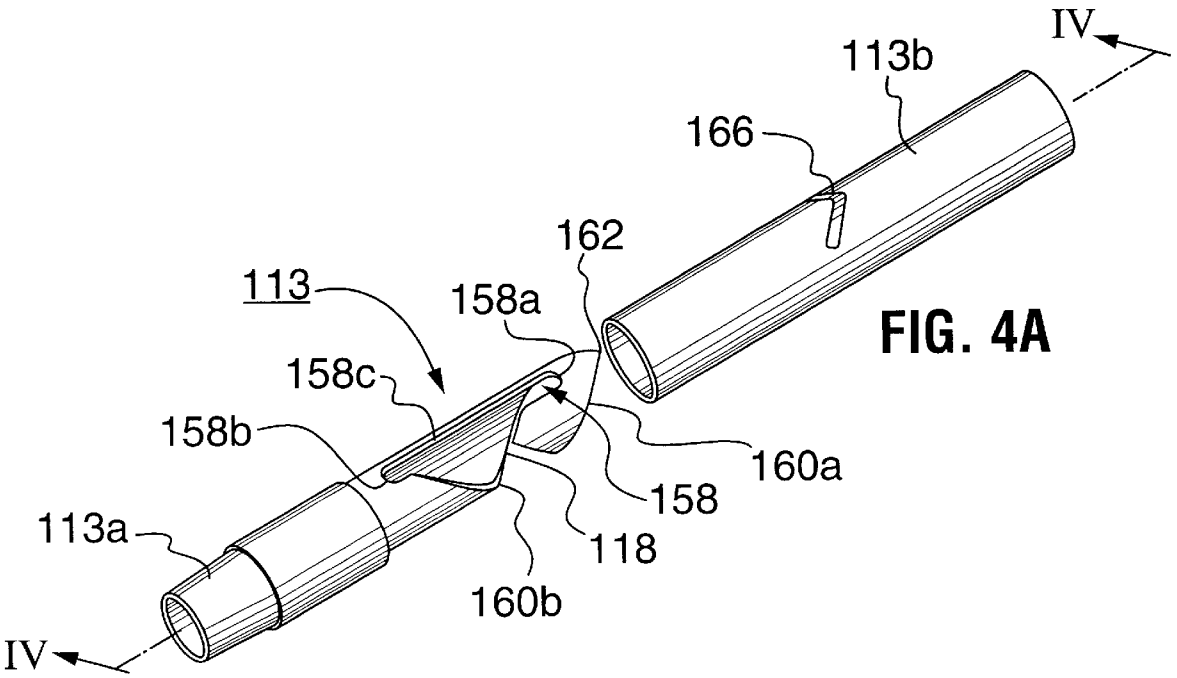
FIG. 4A is an exploded, perspective view of a tubing string hold down sub useful in the present invention.
Figure 4B:
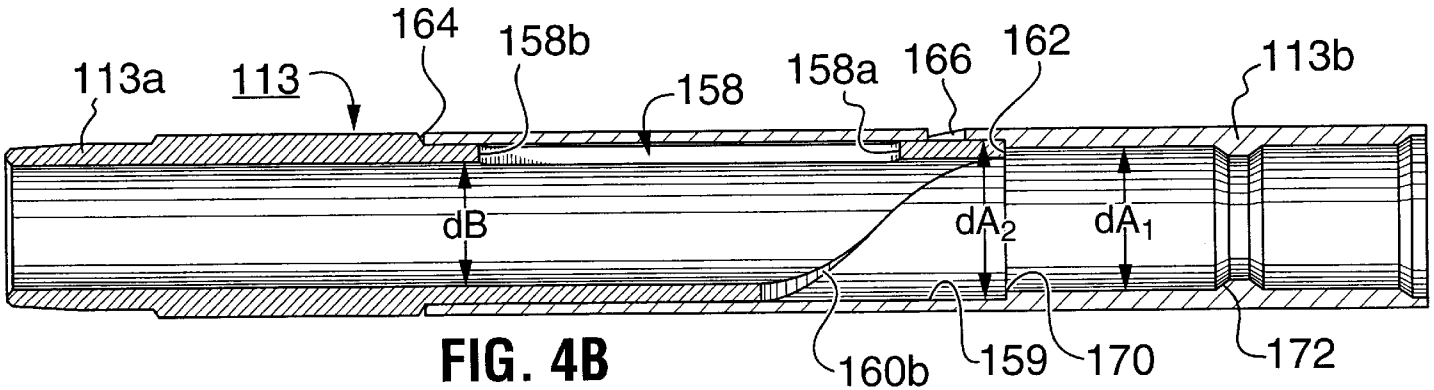
FIG. 4B is a sectional view along line IV—IV of FIG. 4A with the tubing string hold down sub in assembled condition.
Figure 4C:
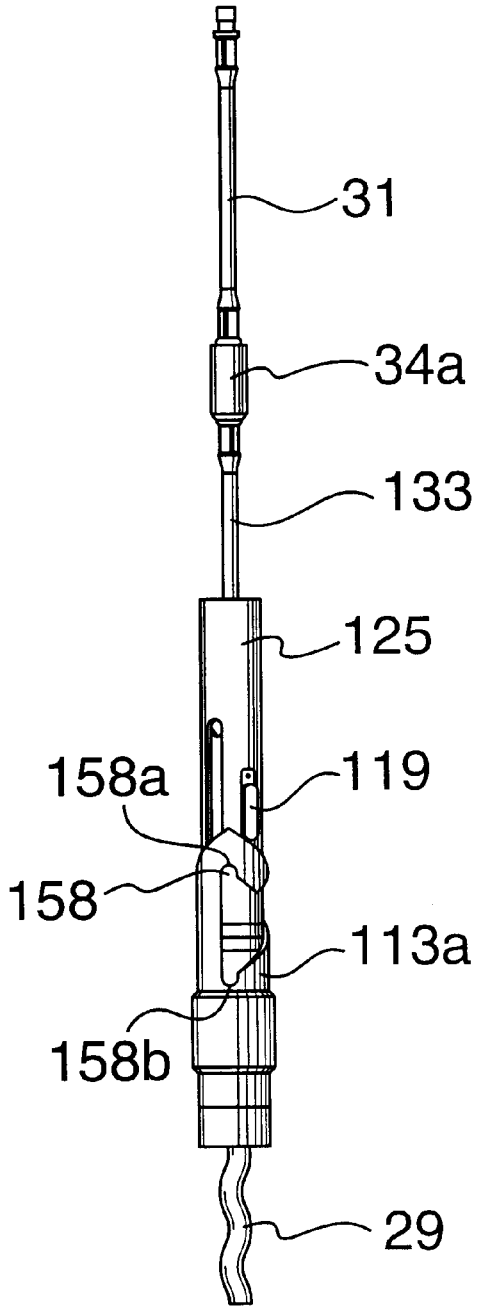
FIGS. 4C and 4D are views of an insert body key entering and engaged in a keyway of a tubing string hold down sub, the sub shown with the outer tube removed.
Figure 4D:
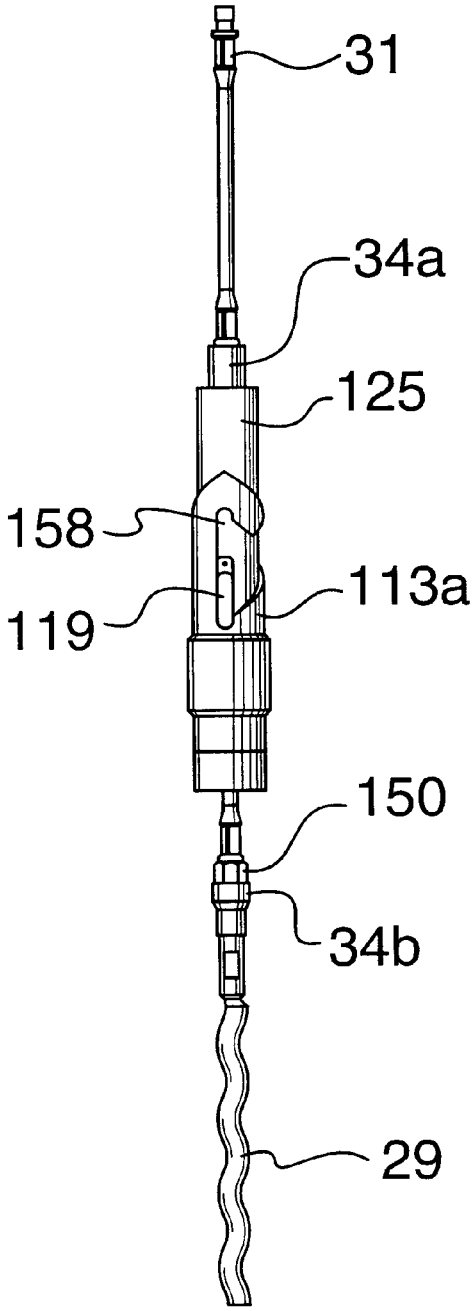

In use, as the pump moves through the tubing string into which it is introduced, key 119 will be compressed against and dragged along the inner wall of the tubing string. When the key reaches tubing sub 113, key 119 will expand out into relief area 159 and pass along the sub's inner wall until it butts against a guiding side 160*a* or 160*b*. If key 119 lands on point 162, the key and thereby the housing will tend to be deflected towards one of the sides. If manipulation of the housing is needed for positioning of the key, hex 150 can be engaged in aperture 128*a* to rotate the pump housing from surface. As shown in FIG. 4C, sides 160*a*, 160*b* guide key 119 through the entrance and then into slot 158. When key 119 is positioned in slot 158, ends 158*a*, 158*b* limit movement of the key, and thereby the pump, upwardly and downwardly in the tubing string. Rotation of the pump during operation, which is in the right hand direction (looking down the tubing string from surface), is limited by abutment of the key against stop side 158*c*. In regular use, key 119 is supported on end 158*b* as shown in FIG. 4D.

To remove the pump from the tubing string, rotor 29 is raised by pulling on drive string until lower sub 34*b* butts against collar and hex 150 is engaged in aperture 128*a*. Using the interlock between the hex and the aperture, pump housing 120 is rotated in a left hand direction from surface to pull the key out of the slot and upwardly through relief area 159. In so doing the key is retracted to allow passage through the tubing string by pulling over profiles 170, 172 which step the diameter from dA2 to dA1 to dB. Radiused end 119*c* must be formed to ride over these profiles. The pump can then be pulled to surface. During this operation, hex 150 is disposed in aperture 128*a* and fluid is free to pass through opening 152*a*, channel 154 and opening 152*b* rather than being swabbed through the tubing string.

Figure 5A:
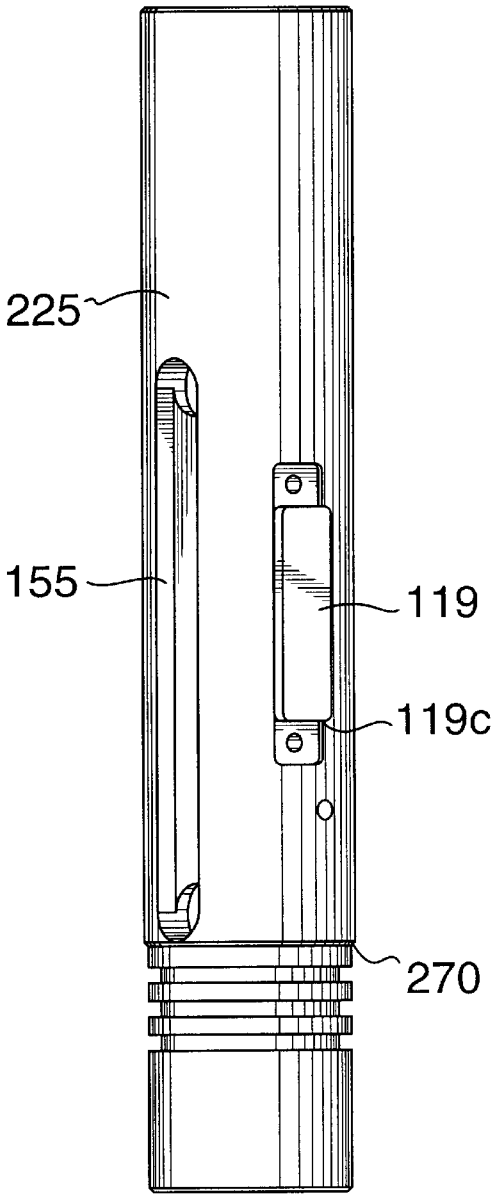
FIG. 5A is side elevation of another insert body.
Figure 5B:
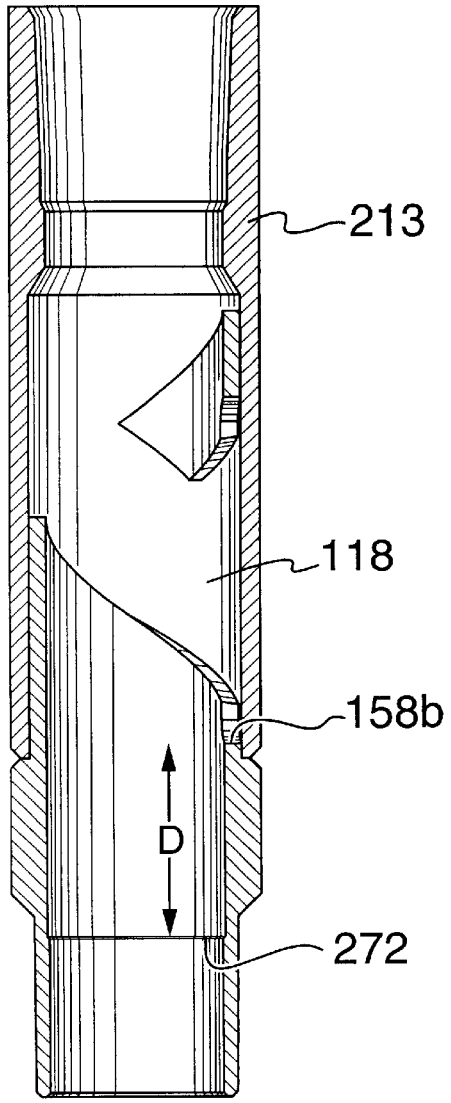
FIG. 5B is a vertical section through a tubing string hold down sub useful with the insert body of FIG. 5A.

In some applications, it may be desirable to provide support for the pump when in the set position in the tubing string in addition to the support provided by the key in the key way. Referring to FIG. 5, an insert body 225 and a tubing string hold down sub 213 are shown that have corresponding support shoulders 270, 272, respectively. Shoulder 270 is formed on the outer surface of insert body 225 below key 119. Likewise, shoulder 272 is formed on the inner wall of sub 213 below key way 118. Shoulder 272 is spaced a distance D below lower end 158*b* of the slot which corresponds to the distance between end 119*c* of the key and shoulder 270 such that when key 119 is positioned in the slot of the keyway, shoulder 270 bears on shoulder 272. Thus, shoulder 272 can bear some of the compressive force on the pump.

The materials of the pump and hold down sub should be selected to withstand downhole conditions. As an example, nitriding can be used to increase steel hardness and wear resistance.

It will be apparent that many other changes may be made to the illustrative embodiments, while falling within the scope of the invention and it is intended that all such changes be covered by the claims appended hereto.

The embodiments of the invention in which an exclusive property or privilege is claimed are defined as follows:

1. An insertable progressing cavity pump, the pump being insertable in a bore of a tubing string by carriage on a drive string, the insertable progressing cavity pump comprising: a stator, a helical rotor locatable in the stator and including a coupling for connection to the drive string, a tubular housing for accommodating the stator therein and sized to be insertable into the tubing string, a pump hold-down arrangement in communication with the housing and disposed above the stator for engaging the pump into the tubing string, and a torque transmitting arrangement acting between the rotor and the housing to transmit torque from the rotor to the housing in both the clockwise and counter-clockwise direction, when the housing is carried on the drive string.

2. The insertable progressing cavity pump of claim 1 further comprising a collar on the housing and an enlarged sub on the coupling that are formed to cooperate to permit the pump to be carried on the drive string.

3. The insertable progressing cavity pump of claim 2 wherein the torque transmitting arrangement is formed above the enlarged sub on the coupling and is selected to engage with an aperture that extends through the collar.

4. The insertable progressing cavity pump of claim 1 wherein the torque transmitting arrangement acting between the rotor and the housing is a portion on the housing selected to engage a portion on with the rotor.

5. The insertable progressing cavity pump of claim 1 wherein the torque transmitting arrangement is corresponding faceted arrangements on the housing and the coupling.

6. The insertable progressing cavity pump of claim 5 wherein the faceted arrangement is a hex.

7. The insertable progressing cavity pump of claim 5 further comprising a fluid bypass arrangement about the torque transmitting arrangement to permit fluid bypass when the coupling faceted arrangement is engaged with the housing faceted arrangement.

8. The insertable progressing cavity pump of claim 1 wherein the torque transmitting arrangement acting between the rotor and the housing is a portion on the housing selected to engage with a portion on the coupling.

9. An insertable progressing cavity pump installation for use in a tubing string in a wellbore, the insertable progressing cavity pump installation comprising: a tubing string insert connectable into the tubing string and having a inner bore defined by an inner wall and a pump hold down arrangement formed on the inner wall and an insertable progressing cavity pump insertable through the tubing string by carriage on a rod string, the pump including a stator, a helical rotor locatable in the stator and including a coupling for connection to the rod string, a tubular housing for accommodating the stator therein and sized to be insertable through the tubing string and a hold down arrangement on the housing disposed above the stator and including an engagement mechanism for engaging with the pump hold down arrangement to releasably secure the pump in the tubing string.

10. The insertable progressing cavity pump installation of claim 9 wherein the pump hold down arrangement is a keyway and the hold down arrangement on the pump is a key.

11. The insertable progressing cavity pump installation of claim 10 wherein the key is biased outwardly from the pump housing to engage in the keyway.

12. The insertable progressing cavity pump installation of claim 10 wherein the keyway includes an upper profile to abut the key and stop the pump housing from moving upwardly out of the keyway.

13. The insertable progressing cavity pump installation of claim 10 wherein the keyway includes side edges to abut the key and limit rotation of the pump housing relative to the tubing string.

14. The insertable progressing cavity pump installation of claim 9 wherein the pump further includes a collar on the housing and an enlarged sub on the coupling that are formed to cooperate to permit the pump to be carried on the drive string.

15. The insertable progressing cavity pump installation of claim 14 wherein the collar is formed adjacent the hold down arrangement on the housing.

16. The insertable progressing cavity pump installation of claim 14 wherein the pump further includes a torque transmitting arrangement acting between the rotor and the housing when the pump is carried on the drive string.

17. The insertable progressing cavity pump installation of claim 9 wherein the housing includes an insert body having a collar for cooperating with an enlarged sub on the coupling to permit the pump to be carried on the drive string and the hold down arrangement on the housing.

18. The insertable progressing cavity pump installation of claim 9 wherein pump hold down arrangement and the hold down arrangement on the housing further releasably secure the pump against rotation in the tubing string.

* * * * *